US011560294B2

(12) United States Patent
Quillard et al.

(10) Patent No.: US 11,560,294 B2
(45) Date of Patent: Jan. 24, 2023

(54) PULLEY WITH SECURED OPENING

(71) Applicant: ZEDEL, Crolles (FR)

(72) Inventors: Christophe Quillard, Eybens (FR); Benoît Vuillermoz, Saint Martin d'Heres (FR)

(73) Assignee: ZEDEL, Crolles (FR)

( * ) Notice: Subject to any disclaimer, the term of this patent is extended or adjusted under 35 U.S.C. 154(b) by 242 days.

(21) Appl. No.: 16/923,673

(22) Filed: Jul. 8, 2020

(65) Prior Publication Data

US 2021/0009389 A1 Jan. 14, 2021

(30) Foreign Application Priority Data

Jul. 8, 2019 (FR) ..... 1907640

(51) Int. Cl.
*B66D 3/08* (2006.01)
*A63G 21/22* (2006.01)

(52) U.S. Cl.
CPC ..... *B66D 3/08* (2013.01); *A63G 21/22* (2013.01)

(58) Field of Classification Search
None
See application file for complete search history.

(56) References Cited

U.S. PATENT DOCUMENTS

2010/0084874 A1* 4/2010 Yiming ..... E05C 9/045 292/113
2018/0216656 A1* 8/2018 Bailey ..... F16B 45/04

FOREIGN PATENT DOCUMENTS

| | | | |
|---|---|---|---|
| CH | 704409 | A1 | 7/2012 |
| EP | 2042401 | A1 | 4/2009 |
| GB | 2522553 | A | 7/2015 |

* cited by examiner

*Primary Examiner* — Charles A Fox
*Assistant Examiner* — William J Gately, III
(74) *Attorney, Agent, or Firm* — Oliff PLC

(57) ABSTRACT

The tandem pulley comprises a pair of sheaves mounted in line between first and second flanges. A gate is fitted rotating with respect to the first flange between closed and open positions. The gate comes into contact with the second flange in the closed position to close a housing. The clamp is movable in rotation on the gate between a locking position locking the gate in the closed position and an unlocking position. The clamp has a prong pressing on the first flange and the gate in the locking position. The clamp has an actuating area separated from the first flange by the gate. Rotation of the actuating area from the locking position to the unlocking position corresponds to a movement of the actuating area away from the second flange. Rotation of the actuating area results in pivoting of the prong.

18 Claims, 4 Drawing Sheets

PULLEY WITH SECURED OPENING

BACKGROUND OF THE INVENTION

The invention relates to a tandem pulley.

PRIOR ART

In a large number of fields, it is known to use a tandem pulley that has to run on a cable. For example, the tandem pulley is commonly used when setting up zip lines with a user sliding along the cable.

The tandem pulley has two rotationally mounted sheaves. The cable is fitted inside the pulley in contact with the two sheaves. The tandem pulley has a connection point for making the mechanical connection between the user suspended from the pulley and the cable securing the pulley. The two sheaves are fitted in line so that both sheaves run on the cable.

The pulley defines a housing for the cable and a slot for inserting or extracting the cable. The cable can be inserted in the housing by means of the slot so as to come into contact with the sheaves. After use, the cable is extracted from the housing by means of the slot.

It is known to have an openable gate having a first position closing the slot and a second position which leaves the slot open. The openable gate is fitted rotatingly and the user presses on the gate so as to enable or prevent the cable from being inserted in or extracted from the housing.

In order to enhance safety, it is also known to install a locking system that keeps the gate secured in the position closing the slot. The locking system is configured to prevent a simple pressing on the openable gate from resulting in opening of the slot. A locking system is used in the pulley marketed by International Safety Components Ltd. under the brand name Zippey™. Opening of the slot is not obtained by pressing on the openable gate but by pressing on a prong connected to the openable gate.

The openable gate is fitted rotating on the rear flange so as to come into contact with the front flange and the locking prong protrudes out beyond the rear flange. To open the housing and insert the cable, the user presses on the prong to move it away from the sheaves which makes the movable gate rotate.

It becomes apparent from experience that such a pulley is not satisfactory in use. As the prong protrudes out beyond the rear flange, it is not immediately visible so that the user does not intuitively understand how to open the pulley. Furthermore, when the user slides along the cable and hooks up to the pulley, his fingers catch on the prong and tend to move the movable gate in the opening direction of the slot which is not what is intended. The same is true for any item sliding along the rear flange which may catch on the locking prong which comprises a hook.

Object of the Invention

One object of the invention consists in providing a tandem pulley having a locking mechanism that is easier to use while procuring an enhanced safety. For this purpose, the tandem pulley comprises:

a first flange and a second flange each having an inner surface and an outer surface, a pair of sheaves mounted in line between the first flange and the second flange, a gate fitted movable in rotation with respect to the first flange between a closed position and an open position, the gate coming into contact with the second flange in the closed position, a housing designed to receive a cable, the housing being bounded by the first flange, the second flange, the pair of sheaves and the gate, the gate closing the housing in the closed position and defining a slot in the open position, a clamp fitted on the gate, the clamp being fitted movable in rotation between a locking position locking the gate in the closed position and an unlocking position allowing movement of the gate between the closed position and the open position, the clamp having a prong pressing on the first flange and on the gate in the locking position.

The tandem pulley is remarkable in that the clamp defines an actuating area separated from the first flange by the gate, rotation of the actuating area from the locking position to the unlocking position corresponding to movement of the actuating area away from the second flange, said rotation of the actuating area causing pivoting of the prong.

In one development, the actuating area and prong are separated by a rotation spindle of the clamp so that said rotation of the actuating area makes the prong move towards the sheaves.

In advantageous manner, the actuating area is a concave actuating area having a pressing surface extending from the rotation spindle in a direction parallel to the axis of rotation of the sheaves when the actuating area is in the locking position.

Preferentially, the concave actuating area has an abutment surface extending from the rotation spindle in the direction of the second flange when the actuating area is in the locking position.

In one development, when the clamp is in the unlocking position and the gate is in the open position, the abutment surface and second flange define a slot opening into the housing designed to receive a cable, the abutment surface separating the pressing surface and second flange, the slot being designed to allow the cable to pass through.

Advantageously, when the clamp is in the unlocking position and the gate is in the open position, the abutment surface is separated from the second flange by a distance smaller than the distance separating the first flange and second flange in the housing.

In a particular embodiment, movement from the blocking position to the unlocking position corresponds to a rotation of the actuating area through an angle greater than or equal to 90°.

In one configuration, movement from the blocking position to the unlocking position corresponds to a rotation of the actuating area through an angle strictly greater than 95°.

Preferentially, the clamp does not present any area salient from the outer surface of the first flange.

In another development, the gate comprises an obstacle salient from the inner surface of the second flange and directed towards the first flange when the prong is in the closed position, the distance between the obstacle and the first flange is less than 12 mm and the first flange is provided with a through hole or a recess arranged to allow the obstacle to pass when the gate is in the open position.

In preferential manner, the gate defines a hook pressing on an aperture of the second flange.

It is a further object of the invention to provide a transportation device guaranteeing a better safety than configurations of the prior art while remaining easy to use.

For this purpose, the transportation device comprises a cable and a tandem pulley according to one of the foregoing configurations, the cable being located in the housing.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which.

DESCRIPTION OF THE EMBODIMENTS

Figure 1:
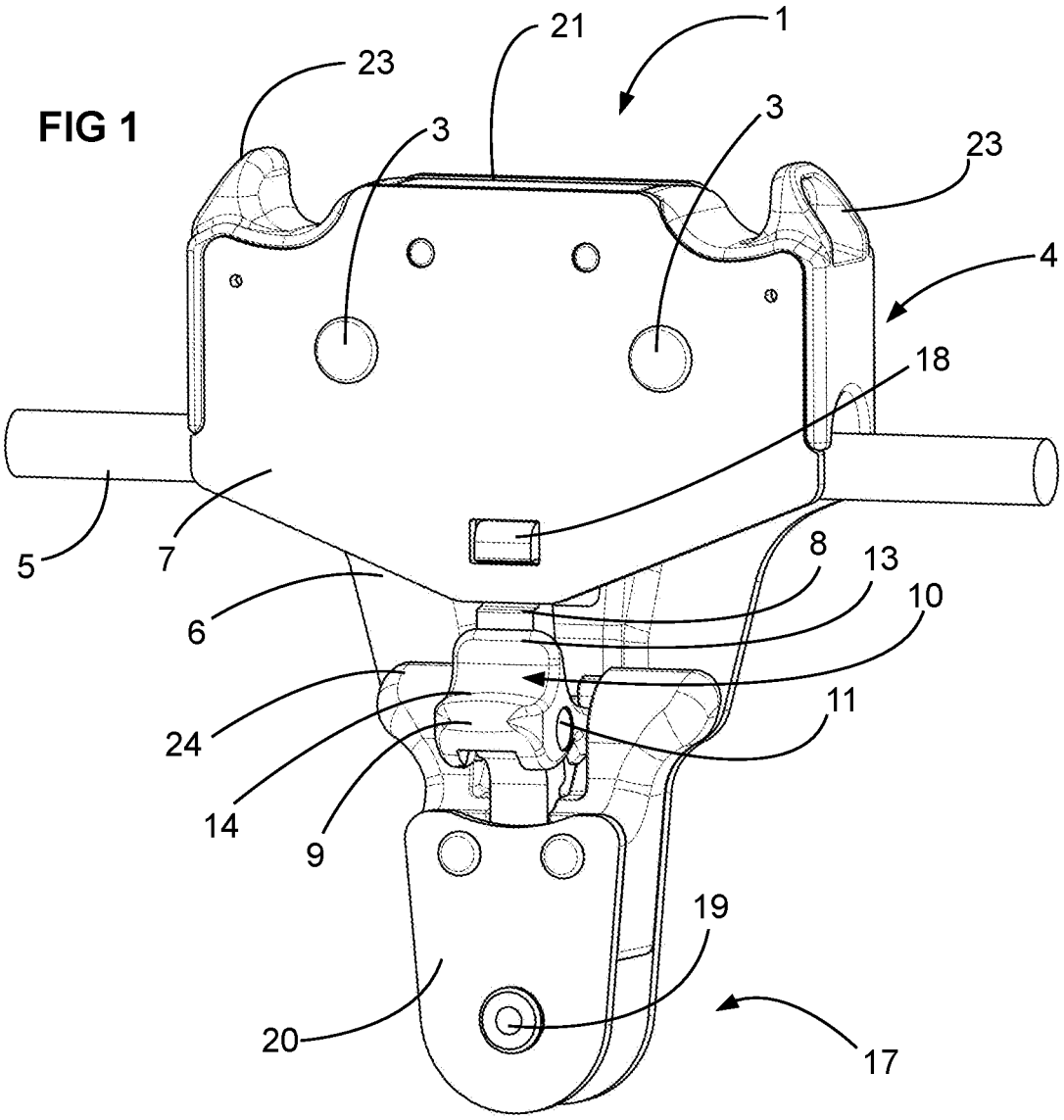
FIG. 1 schematically illustrates a tandem pulley with a gate in the closed position and the clamp in the locking position, a cable being fitted in the housing in contact with the sheaves.
Figure 2:
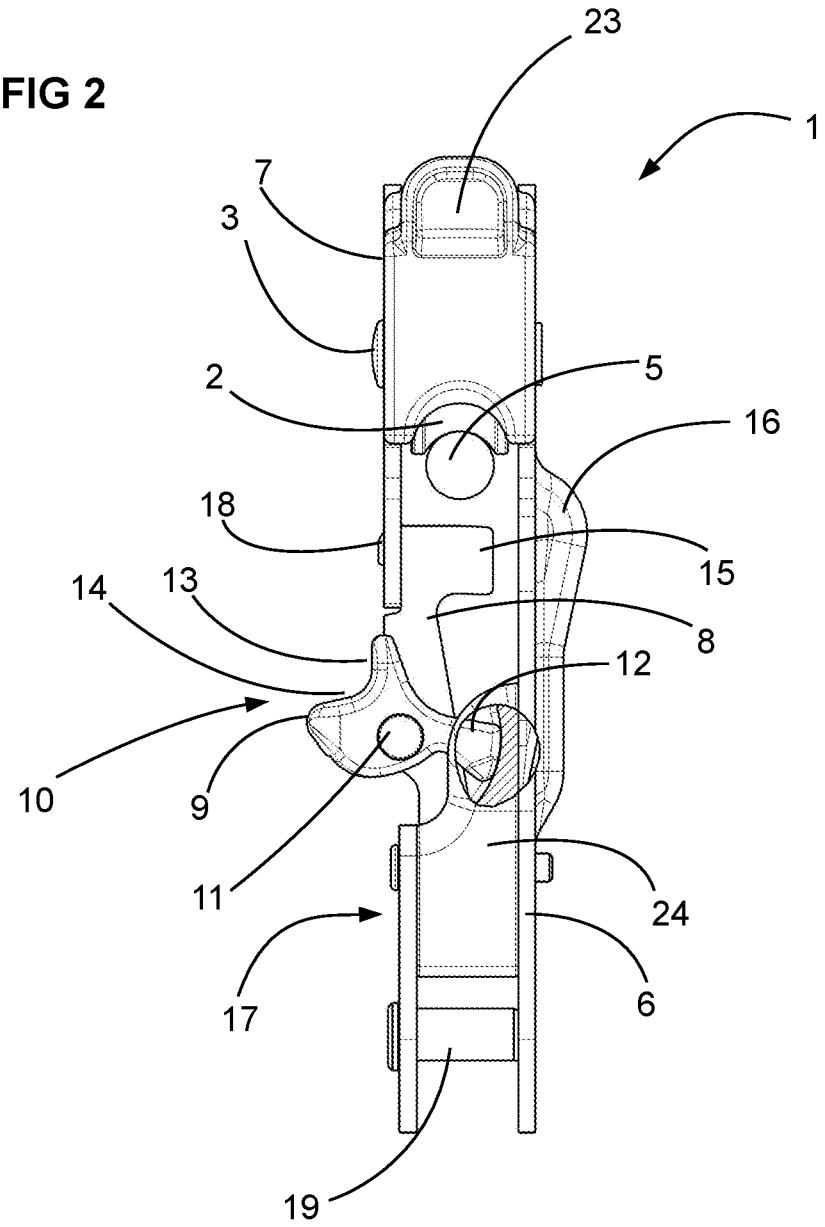
FIG. 2 schematically represents a side view of a tandem pulley with the gate in the closed position and the clamp in the locking position, a cable being fitted in the housing in contact with the sheaves.

As illustrated in FIGS. 1 to 4, a tandem pulley device 1 comprises a pair of sheaves 2 advantageously having identical structures. Pair of sheaves 2 is fitted in line. Each sheave 2 is fitted rotating freely on a spindle 3. The two spindles 3 are fixed on a support bracket 4. Support bracket 4 is advantageously in the shape of an inverted U. Support bracket 4 can be a metal support bracket.

Support bracket 4 can be formed by a metal sheet deformed to define a U-shape or substantially a U-shape. Support bracket 4 can be formed by assembly of several parts.

Such a device is designed to form part of a transportation device used for aerial transportation of a person when performing Tyrolean traversing on a rope or cable. Tandem pulley 1 runs along a fixed cable 5.

Support bracket 4 has a first flange 6 and a second flange 7.

The two sheaves 2 are mounted moving in rotation by means of two rotation spindles 3. The two rotation spindles 3 are fitted parallel to one another. The two rotation spindles 3 define two different axes of rotation. In the illustrated embodiment, the two axes of rotation 3 belong to the same plane which divides each sheave 2 into two equal parts. In advantageous manner, the two sheaves 2 are mounted fixed on bracket 4.

The two rotation spindles 3 are fixed to first and second flanges 6 and 7. The two sheaves 2 are fitted between first and second flanges 6 and 7. The two sheaves 2 are facing the inner surfaces of the two flanges 6 and 7.

Tandem pulley 1 comprises a gate 8 configured to be movable between a first position and a second position. The mobility of the gate 8 enables the insertion or extraction slot of cable 5 to be defined. In the first position or closed position, gate 8 closes the slot and cable 5 located in the housing cannot be extracted. In the second position or open position, gate 8 defines a slot with second flange 7 to allow cable 5 to be inserted or extracted. Gate 8 is separated from second flange 7 by a distance ensuring that cable 5 is able to pass.

The housing is partly defined by first flange 6, second flange 7, gate 8 and the two sheaves 2.

Gate 8 is fitted rotating between the two positions to define the slot or not. Gate 8 is fitted around rotation spindle which is fixed on first flange 6. The rotation spindle defines an axis of rotation of gate 8 which is advantageously located parallel to an axis passing through the two axes of rotation of the two sheaves 2 and which is perpendicular to the two axes of rotation of sheaves 2.

It is advantageous to use a spring connected to first flange 6 and to gate 8. The spring is configured to move movable gate 8 to the closed position thereby closing the slot if no mechanical stress is applied. The spring applies a force on gate 8 to direct the latter towards second flange 7.

Gate 8 is associated with a clamp 9 performing unlocking of gate 8 in the closed position even if gate 8 is subjected to a mechanical stress. Clamp 9 is fitted on gate 8 so as to move with the movements of gate 8. Clamp 9 has an actuating area 10 which is fitted on gate 8. Actuating area 10 is designed to collaborate with the user's finger.

Clamp 9 is fitted movable between a first position and a second position. The first position of clamp 9 is a locking position keeping movable gate 8 in the closed position. The second position of clamp 9 is an unlocking position allowing movement of gate 8 between the closed position and the open position. Clamp 9 is fitted movable with respect to gate 8 and with respect to first flange 6.

In advantageous manner, clamp 9 is fitted able to rotate with respect to gate 8. It is particularly advantageous to use a clamp 9 fitted rotating around a rotation spindle 11 fitted in fixed manner on gate 8. Actuating area 10 is arranged rotationally around rotation spindle 11. The axis of rotation of clamp 9 is different from the axis of rotation of gate 8. For example, rotation spindle 11 of clamp 9 defines an axis of rotation that is parallel to the axis of rotation of movable gate 8. The axis of rotation of clamp 9 is located between the axis of rotation of movable gate 8 and the contact point with second flange 7.

In the locking position, clamp 9 presses on first flange 6 directly or indirectly for example by means of a prong 12. The bearing force opposes movement of gate 8 from the closed position to the open position. In another configuration, clamp 9 presses on gate 8 by means of prong 12. In its locking position, prong 12 opposes rotation of gate 8. Clamp 9 preferentially has a rotationally mounted prong 12. In advantageous manner, in the locking position, clamp 9 presses on the inner surface of first flange 6, i.e. the surface that is facing sheaves 2.

In the unlocking position, clamp 9 allows movement of gate 8 towards first flange 6 for example by not simultaneously pressing on first flange 6 and on gate 8.

When movement takes place from the blocking position to the unlocking position, actuating area 10 moves in rotation away from sheaves 2 and from second flange 7. The movement of actuating area 10 results in movement of prong 12 which advantageously moves towards sheaves 2.

Actuating area 10 of clamp 9 is visible on the front surface of the pulley, i.e. the surface comprising the slot. Actuating area 10 is salient from the front surface of pulley 1 making it easier for the user to actuate as he can directly see the area to be used to open pulley 1. This configuration enables a clamp 9 to be had that is not salient from the outer rear surface of the pulley thereby enhancing safety during use.

In the illustrated configuration, clamp 9 is formed in a single piece and is partly situated in the housing designed to receive cable 5. Prong 12 is fitted forming a single part with actuating area 10. Prong 12 is fitted rotating around rotation spindle 11. Rotation spindle 11 separates prong 12 and actuating area 10. The bearing force of prong 12 on first flange 6 results in locking of gate 8 as rotation spindle of clamp 9 is fixed to gate 8.

Advantageously, actuating area 10 is located at one end of clamp 9 and the opposite end is formed by prong 12 which presses on first flange 6 when clamp 9 is in the locking position.

In an alternative embodiment that is not illustrated, prong 12 is fitted rotating with an axis of rotation that is different from that of actuating area 10. Rotation of prong 12 is caused by rotation of actuating area 10. The rotation spindle of prong 12 can be fitted on first flange 6. This embodiment is less advantageous than the previous embodiment as it requires more component parts thereby increasing its size.

Figure 3:
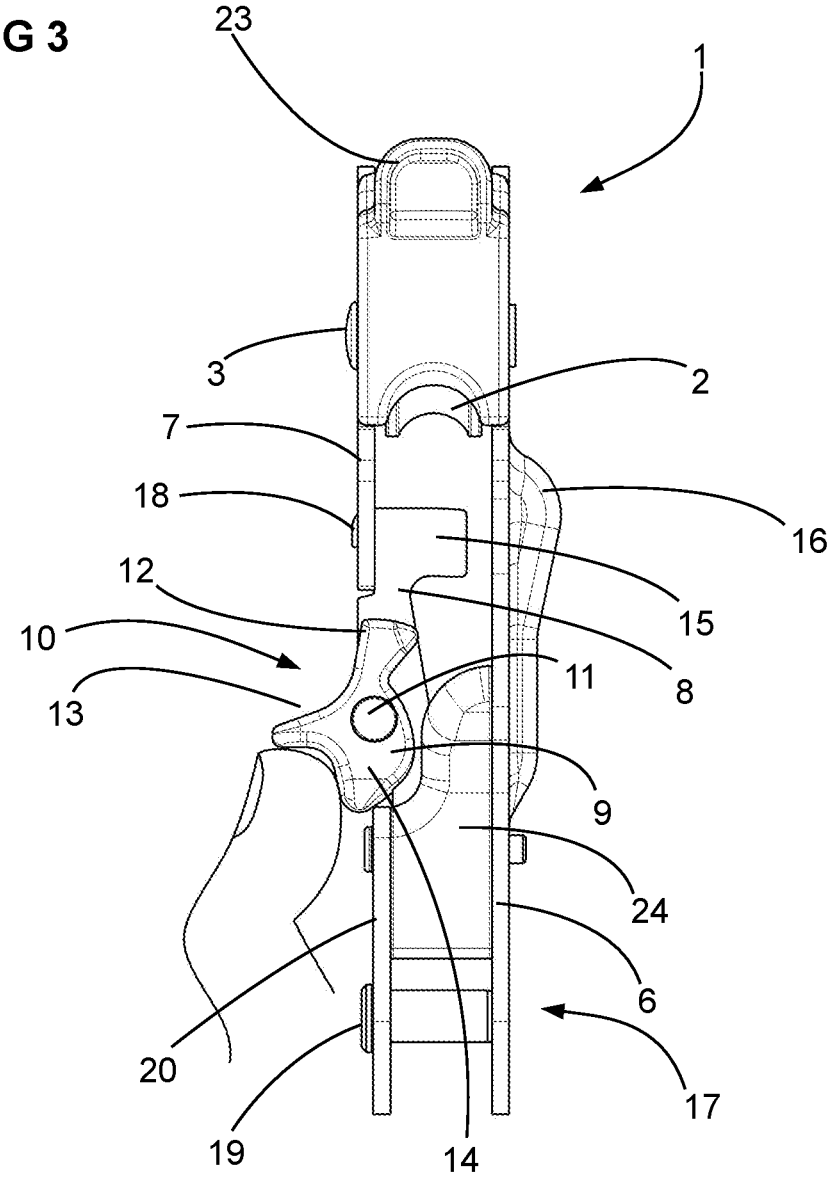
FIG. 3 schematically represents a side view of a tandem pulley with the gate in the closed position and the clamp in the unlocking position.
Figure 4:
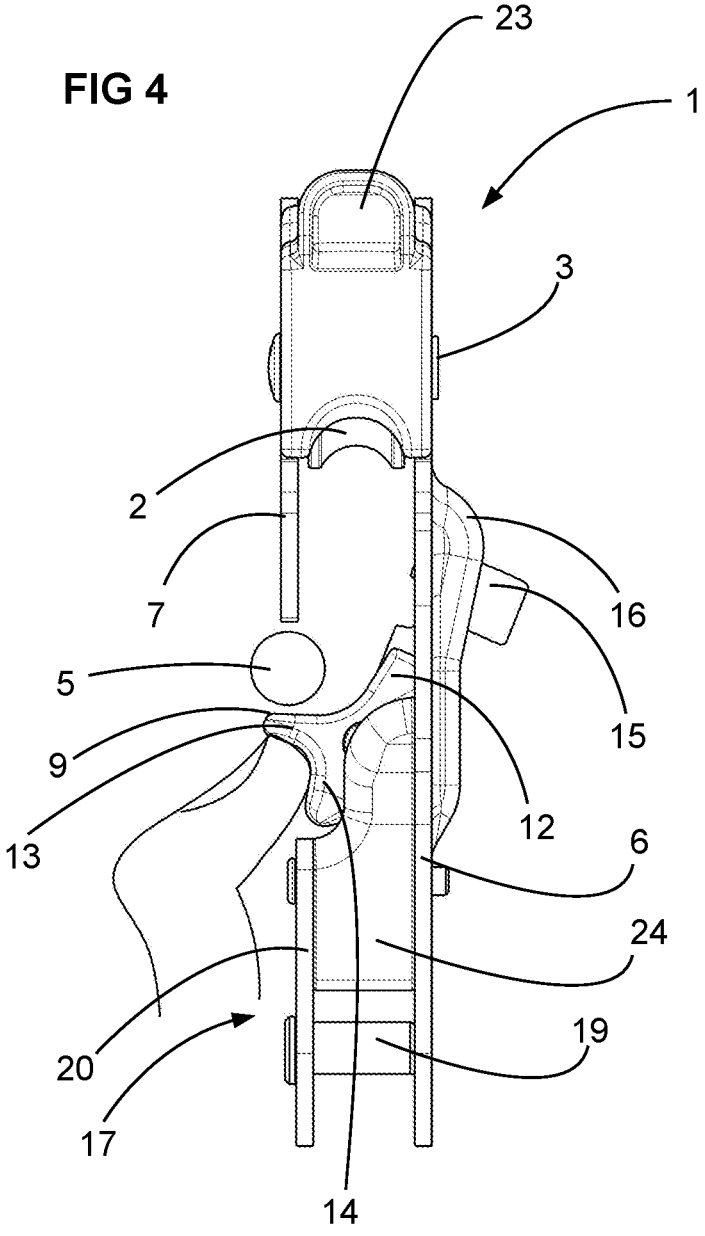
FIG. 4 schematically represents a side view of a tandem pulley with the gate in the open position and the clamp in the unlocking position, the cable being inserted in the housing of the tandem pulley.

Preferentially, prong 12 is in the form of two parts that are separated by gate 8 along the axis of rotation of clamp 9. The two salient parts ensure a better transmission of the forces and can move so as to be adjacent to the gate in a direction parallel to the axis of rotation of the gate as illustrated in FIG. 3.

Actuating area 10 is advantageously a concave actuating area and not a convex actuating area. Actuating area 10 defines a recess that incites the user to place a finger in the recess to move clamp 9 and then gate 8.

Concave actuating area 10 has an abutment surface 13 and a pressing surface 14 which represent two distinct surfaces that meet to define the concavity. In the locking position, abutment surface 13 covers gate 8 extending mainly from rotation spindle 11 towards second flange 7, i.e. towards the two sheaves 2.

Abutment surface 13 extends substantially along the longitudinal axis of gate 8 to prevent any direct contact between the user's finger and gate 8 when clamp 9 is in the locking position. The area of pressing surface 14 is arranged salient from gate 8 extending orthogonally to the axis of rotation of clamp 9 and orthogonally to the longitudinal axis of gate 8. Pressing surface 14 extends from rotation spindle 11 in a parallel direction to the axis of rotation of sheaves 2. Pressing surface 14 is arranged salient from the front surface of the pulley thereby making the clamp easier to actuate. Pressing surface 14 is an area arranged fixed with respect to abutment surface 13. In advantageous manner, abutment surface 13 covers at least 50% of the distance separating the axis of rotation of clamp 9 and second flange 7 in the closed position, preferably at least 75%.

The abutment surface is optional in actuation of the clamp from the locking position. When movement of clamp 9 takes place from the locking position to the unlocking position, actuating area 10 moves away from the two sheaves 2 and away from second flange 7. Abutment surface 13 pivots moving away from second flange 7. In this way, the user's finger that moves actuating area 10 is naturally at a distance from second flange 7 thereby avoiding obstructing the slot and facilitating insertion or extraction of cable 5. Abutment surface 13 and second flange 7 define a slot opening into the housing designed to receive a cable 5. Abutment surface 13 separates pressing surface 14 and second flange 7. The slot is designed to allow cable 5 to pass through.

When clamp 9 is in the unlocking position and gate 8 is in the open position, it is advantageous for abutment surface 13 to be separated from second flange 7 by a distance smaller than the distance separating first flange 6 from second flange 7 in the housing. The slot enables the cable to be inserted while at the same time enabling a compact clamp to be formed.

The inventors observed that with a pulley provided with a swivelling gate 8, the user pushes on gate 8 to move it towards first flange 6 and define the slot. However, when the user performs this push to open pulley 1, his finger naturally slides towards the second flange, due to the swivelling, so that the user's finger moves into the slot obstructing the latter. To eliminate or reduce this inconvenience, the height of the slot has to be increased and/or the separating distance between the actuating area and the slot has to be increased. To circumvent this problem, the Zippey™ pulley presented in the foregoing uses an actuating area arranged on the rear surface of the pulley which is less intuitive as far as its operation is concerned.

On the contrary, by means of concave actuating area 10, when the user presses on actuating area 10 to move gate 8, abutment area 13 opposes sliding of the user's finger. The pressure applied on gate 8 to make gate 8 swivel is directed differently from the rotation of actuating area 10.

Clamp 9 remains in the unlocking position and the force applied by the user on actuating area 10 moves gate 8 towards first flange 6 to define the slot. In an advantageous configuration, the slot is defined at one end by the distance between second flange 7 and abutment surface 13 and at the other end by the distance between second flange 7 and gate 8. The user's finger is protected from any contact with cable 5 by abutment surface 13.

In a preferential embodiment, clamp 9 defines an end-of-travel stop when movement takes place from the first position to the second position. Once the end-of-travel stop has been reached, pressing on actuating area 10 results in a force being applied on gate 8 moving gate 8 from the closed position to the open position.

Actuating area 10 of clamp 9 also forms the actuating area of gate 8 so that the user's finger is able to move clamp 9 from the locking position to the unlocking position and the force applied in the unlocking position moves gate 8.

In the illustrated configuration, actuating area 10 is separated from first flange 6 by gate 8. Rotation spindle 11 of clamp 9 is fitted between the rotation spindle of gate 8 and the end of gate 8 that comes into contact with second flange 7 to close the slot.

In advantageous manner, movement of actuating area 10 from the locking position to the unlocking position corresponds to a rotation through an angle greater than or equal to 90° and preferentially greater than 95°. Such a rotation makes it possible to differentiate better between the movement causing unlocking of clamp 9 and the movement causing opening of the slot. A downward vertical movement applied on the pulley illustrated in FIG. 1 thus results in unlocking of clamp 9 without opening of gate 8. The same movement applied on the Zippey™ pulley results in opening of the pulley. In the pulley illustrated in FIG. 1, the downward vertical movement is then associated with a horizontal movement towards first flange 6 to open the slot. Safety is enhanced by means of two consecutive forces in two different directions to achieve opening of the pulley.

In a particular embodiment, movable gate 8 has an obstacle 15 that is arranged between first flange 6 and second flange 7. Obstacle 15 is movable between the two flanges 6 and 7. First flange 6 defines a through hole and/or a recess 16 collaborating with obstacle 15. Recess 16 does not extend over the whole width of first flange 6. The width is measured along the longitudinal axis of cable 5 or the axis perpendicular to the two axes of rotation of sheaves 2 passing through the two axes of rotation. In the open position, obstacle 15 sinks partially into the through hole and/or into recess 16. Obstacle 15 is configured to at least partially obstruct the space between the two flanges 6 and 7 and to prevent cable 5 from placing itself between gate 8 and first flange 6 preventing cable 5 from being extracted.

Obstacle 15 collaborates with the two flanges 6 and 7 so that the obstruction length of obstacle 15 in the housing changes depending on whether gate 8 is in the closed position or in the open position. The length is measured in the direction that passes through first flange 6 and second flange 7. The obstruction length is greater in the closed position than in the open position. In the closed position, the obstruction length prevents the cable from passing between first flange 6 and obstacle 15. The distance between obstacle 15 and first flange 6 is smaller than the diameter of cable 5. In the open position, the distance between obstacle 15 and second flange 7 is greater than the diameter of cable 5.

In the closed position, obstacle 15 extends over a first distance from first flange 6 towards second flange 7. The first distance is smaller than or equal to the minimum distance separating the two flanges 6 and 7 in a plane parallel to the plane containing the two axes of rotation of sheaves 2 passing through obstacle 15. The difference between the first distance and the minimum distance separating the two flanges 6 and 7 is smaller than the diameter of cable 5, for example 12 mm. Cable 5 has a tension or a rigidity preventing it from deforming and passing between obstacle 15 and first flange 6. Cable 5 remains between obstacle 15 and sheaves 2.

In the open position, obstacle 15 sinks into recess 16 and/or into the through hole so that the distance separating obstacle 15 and second flange 7 is greater than the diameter of cable 5. This enables cable 5 to be inserted and extracted.

Obstacle 15 enables movement of cable 5 to be limited and prevents cable 5 from getting stuck between gate 8 and first flange 6. If this sticking occurs, it is not possible to extract the cable or even to open gate 8.

The tandem pulley comprises an attachment point 17 designed to mechanically connect the user with the pulley. The attachment point 17 enables a lanyard, a strap, a rope or a carabiner to be inserted.

In a particular configuration, gate 8 comprises a hook 18 collaborating with second flange 7. Hook 18 preferably collaborates with a through hole of second flange 7. The through hole passes through the inner wall and the outer wall of second flange 7.

In an advantageous embodiment, hook 18 presses against the side wall of second flange 7 when the force applied on attachment point 17 reaches a threshold value. The threshold force advantageously corresponds to a user suspended on attachment point 17. In a particular configuration, pressing of hook 18 against the side wall of second flange 7 prevents opening of the slot.

In advantageous manner, pulley 1 has an attachment point 17 located underneath the housing.

In the illustrated embodiment, an attachment point 17 is formed by a pin 19 extending from first flange 6. In advantageous manner, pin 19 extends up to an additional second flange 20 that is fixed to first flange 6 by other means. The connections between pin 19, first flange 6 and additional second flange 20 enable a part of the forces applied on pin 19 to be transmitted to first flange 6.

In a particular configuration, first flange 6 is connected to second flange 7 by means of a support 21. Support 21 can have a top surface defining one or two notches 22 arranged at the ends of the support bracket in the longitudinal direction of cable 5. Each notch 22 can be configured to secure a carabiner. In advantageous manner, notch 22 is configured to define a recess located between rotation spindle 3 and the end of the support. Notch 22 can be formed by a part 23 defining a cusp.

In a particular configuration, the rotation spindle of movable gate 8 is fitted on a spacer 24 configured to shift the axis of rotation with respect to first flange 6. Spacer 24 is fitted between first flange 6 and additional second flange 20.

In a specific configuration, clamp 9 presses on spacer 24 which is itself pressing on first flange 6.

The invention claimed is:

1. A tandem pulley comprising:

a first flange and a second flange each having an inner surface and an outer surface, a pair of sheaves mounted in line between the first flange and the second flange, a gate fitted movable in rotation with respect to the first flange between a closed position and an open position, the gate coming into contact with the second flange in the closed position, a housing designed to receive a cable, the housing being bounded by the first flange, the second flange, the pair of sheaves and the gate, the gate closing the housing in the closed position and defining a slot in the open position, a clamp mounted rotative around a rotation spindle fixed to the gate, the clamp being fitted movable in rotation between a locking position locking the gate in the closed position and an unlocking position allowing movement of the gate between the closed position and the open position, the clamp having a prong pressing on the first flange and on the gate in the locking position, and wherein the clamp is mounted rotative around a rotation spindle fixed to the gate wherein the clamp defines an actuating area separated from the first flange by the gate, rotation of the actuating area from the locking position to the unlocking position corresponding to movement of the actuating area away from the second flange, said rotation of the actuating area causing pivoting of the prong.

2. The tandem pulley according to claim 1, wherein the actuating area and the prong are separated by a rotation spindle of the clamp so that said rotation of the actuating area makes the prong move away from or towards the sheaves.

3. The tandem pulley according to claim 2, wherein the actuating area is a concave actuating area having a pressing surface extending from the rotation spindle in a parallel direction to the axis of rotation of the sheaves when the actuating area is in the locking position.

4. The tandem pulley according to claim 3, wherein the concave actuating area has an abutment surface extending from the rotation spindle in the direction of the second flange when the actuating area is in the locking position.

5. The tandem pulley according to claim 4, wherein, when the clamp is in the unlocking position and the gate is in the open position, the abutment surface and the second flange define a slot opening into the housing designed to receive a cable, the abutment surface separating the pressing surface and the second flange, the slot being designed to allow the cable to pass.

6. The tandem pulley according to claim 5, wherein, when the clamp is in the unlocking position and the gate is in the open position, the abutment surface is separated from the second flange by a distance smaller than the distance separating the first flange from the second flange in the housing.

7. The tandem pulley according to claim 3, wherein movement from the locking position to the unlocking position corresponds to a rotation of the actuating area through an angle greater than or equal to 90°.

8. The tandem pulley according to claim 7, wherein movement from the locking position to the unlocking position corresponds to a rotation of the actuating area through an angle strictly greater than 95°.

9. The tandem pulley according to claim 1, wherein the clamp does not present any area salient from the outer surface of the first flange when observed in a direction corresponding to an axis perpendicular to rotation axis of the sheaves.

10. The tandem pulley according to claim 1, wherein the gate comprises an obstacle salient from the inner surface of the second flange and directed towards the first flange when the prong is in the closed position, the distance between the obstacle and the first flange is smaller than 12 mm and wherein the first flange is provided with a through hole or a recess arranged to allow the obstacle to pass when the gate is in the open position.

11. The tandem pulley according to claim 1, wherein the gate defines a hook pressing on an aperture of the second flange.

12. A transportation device comprising a cable and a tandem pulley according to claim 1, the cable being arranged in the housing.

13. A tandem pulley comprising:

a first flange and a second flange each having an inner surface and an outer surface, a pair of sheaves mounted in line between the first flange and the second flange, a gate fitted movable in rotation with respect to the first flange between a closed position and an open position, the gate coming into contact with the second flange in the closed position, a housing designed to receive a cable, the housing being bounded by the first flange, the second flange, the pair of sheaves and the gate, the gate closing the housing in the closed position and defining a slot in the open position, a clamp fitted on the gate, the clamp being fitted movable in rotation between a locking position locking the gate in the closed position and an unlocking position allowing movement of the gate between the closed position and the open position, the clamp having a prong pressing on the first flange and on the gate in the locking position, wherein:

the clamp defines an actuating area separated from the first flange by the gate, rotation of the actuating area from the locking position to the unlocking position corresponding to movement of the actuating area away from the second flange, said rotation of the actuating area causing pivoting of the prong, the actuating area and the prong are separated by a rotation spindle of the clamp so that said rotation of the actuating area makes the prong move away from or towards the sheaves, and the actuating area is a concave actuating area having a pressing surface extending from the rotation spindle in a parallel direction to the axis of rotation of the sheaves when the actuating area is in the locking position, and having an abutment surface extending from the rotation spindle in the direction of the second flange when the actuating area is in the locking position.

14. The tandem pulley according to claim 13, wherein, when the clamp is in the unlocking position and the gate is in the open position, the abutment surface and the second flange define a slot opening into the housing designed to receive a cable, the abutment surface separating the pressing surface and the second flange, the slot being designed to allow the cable to pass.

15. The tandem pulley according to claim 14, wherein, when the clamp is in the unlocking position and the gate is in the open position, the abutment surface is separated from the second flange by a distance smaller than the distance separating the first flange from the second flange in the housing.

16. A transportation device comprising a cable and a tandem pulley according to claim 13, the cable being arranged in the housing.

17. A tandem pulley comprising:

a first flange and a second flange each having an inner surface and an outer surface, a pair of sheaves mounted in line between the first flange and the second flange, a gate fitted movable in rotation with respect to the first flange between a closed position and an open position, the gate coming into contact with the second flange in the closed position, a housing designed to receive a cable, the housing being bounded by the first flange, the second flange, the pair of sheaves and the gate, the gate closing the housing in the closed position and defining a slot in the open position, a clamp fitted on the gate, the clamp being fitted movable in rotation between a locking position locking the gate in the closed position and an unlocking position allowing movement of the gate between the closed position and the open position, the clamp having a prong pressing on the first flange and on the gate in the locking position, wherein:

the clamp defines an actuating area separated from the first flange by the gate, rotation of the actuating area from the locking position to the unlocking position corresponding to movement of the actuating area away from the second flange, said rotation of the actuating area causing pivoting of the prong, and the gate comprises an obstacle salient from the inner surface of the second flange and directed towards the first flange when the prong is in the closed position, the distance between the obstacle and the first flange is smaller than 12 mm and wherein the first flange is provided with a through hole or a recess arranged to allow the obstacle to pass when the gate is in the open position.

18. A transportation device comprising a cable and a tandem pulley according to claim 17, the cable being arranged in the housing.

* * * * *